United States Patent [19]

Korenberg

[11] Patent Number: 4,989,549

[45] Date of Patent: Feb. 5, 1991

[54] ULTRA-LOW NOX COMBUSTION APPARATUS

[75] Inventor: Jacob Korenberg, York, Pa.

[73] Assignee: Donlee Technologies, Inc., York, Pa.

[21] Appl. No.: 255,994

[22] Filed: Oct. 11, 1988

[51] Int. Cl.[5] ..... F22B 7/12

[52] U.S. Cl. ..... 122/149; 110/234; 110/264; 122/44.2; 122/136 R; 122/155.2; 431/173

[58] Field of Search ..... 110/264, 347, 234; 431/10, 173; 122/136 R, 136 A, 149, 155 A, 44 A

[56] References Cited

U.S. PATENT DOCUMENTS

| | | | |
|---|---|---|---|
| 1,988,968 | 1/1935 | Gautzsch | 122/136 R |
| 4,098,255 | 7/1978 | Nowak et al. . | |
| 4,245,980 | 1/1981 | Reed et al. . | |
| 4,257,763 | 3/1981 | Reed . | |
| 4,289,474 | 9/1981 | Honda et al. . | |
| 4,347,052 | 8/1982 | Reed et al. . | |
| 4,381,718 | 5/1983 | Carver et al. | 110/347 |
| 4,395,223 | 7/1983 | Okigami et al. . | |
| 4,412,558 | 11/1983 | Burke et al. | 122/155 A |
| 4,431,403 | 2/1984 | Nowak et al. . | |
| 4,434,723 | 3/1984 | Brealey et al. . | |
| 4,441,879 | 4/1984 | Wagner et al. . | |
| 4,453,913 | 6/1984 | Gitman . | |
| 4,565,137 | 1/1986 | Wright . | |
| 4,575,332 | 3/1986 | Oppenberg et al. . | |
| 4,614,492 | 9/1986 | Olsson . | |
| 4,618,323 | 10/1986 | Mansour | 431/190 |
| 4,626,195 | 12/1986 | Sato et al. . | |
| 4,626,204 | 12/1986 | Saint Julian et al. . | |
| 4,669,399 | 6/1987 | Martin et al. | 431/4 X |
| 4,685,404 | 8/1987 | Sheppard et al. | 110/347 X |
| 4,721,454 | 1/1988 | Schirmer et al. . | |
| 4,765,258 | 8/1988 | Zauderer | 110/264 X |
| 4,784,600 | 11/1988 | Moreno | 431/10 X |

*Primary Examiner*—Edward G. Favors

*Attorney, Agent, or Firm*—Finnegan, Henderson, Farabow, Garrett & Dunner

[57] ABSTRACT

A combustion apparatus for staged combustion inside the Morison tube of a firetube boiler for lowering the concentration of $NO_x$ in the exhaust gases. Combustion occurs in a first and second stage, the first stage being sub-stoichiometric combustion and the second stage being above-stoichiometric combustion. In two embodiments of the combustion apparatus, the first stage combustion occurs directly adjacent the inlet end of the boiler furnace and the second stage combustion occurs inside the boiler furnace which acts as a combustion apparatus. In other embodiments of the combustion apparatus, both the first and second stage combustion occur inside the boiler furnace which acts as a combustion apparatus. Swirling and/or cyclonic combustion is utilized in the first and second stages of the combustion apparatus. There is provided heat exchange means surrounding and extending substantially throughout the axial length of the combustion chamber, i.e., the boiler furnace, for absorbing heat and cooling the combustion gases therein.

45 Claims, 8 Drawing Sheets

ULTRA-LOW NOX COMBUSTION APPARATUS

BACKGROUND OF THE INVENTION

1. Field of the Invention

The present invention relates to a combustion apparatus, and more particularly to a combustion apparatus utilizing swirling or cyclonic combustion for high specific heat release while producing exhaust gases with ultra-low concentrations of nitrogen oxide, commonly known as $NO_x$.

2. Description of the Related Art

In the past, cyclone combustion chambers have been used to produce a cyclone of turbulent gases within a combustion chamber for combusting various solid materials, including poor quality coal and vegetable refuse. Combustors of this type are disclosed in "Combustion and Swirling Flows: A Review," N. Syred and J. M. Beer, Combustion and Flame, Volume 23, pages 143–201 (1974). This document is incorporated herein by reference. A firetube boiler having a cyclonic combustor was commercially marketed by Cyclotherm Division, Oswego Package Boiler Co., Inc.

Although known adiabatic cyclone combustors provide high specific heat release, such known combustors have the disadvantage that combustion temperature and $NO_x$ emissions are high. Moreover, in conventional cyclone combustors, combustion is unstable at low capacity burning and high turndown ratios are not possible in non-adiabatic combustors. The turndown ratio of a combustion apparatus in a boiler, defined as the ratio of maximum load to minimum load, measures the ability of the boiler to operate over the extremes of its load ranges. A high turndown ratio allows for a wide range in the level of steam generation at a particular time. This wide range is important to allow the boiler to efficiently respond to varying steam demands.

With pollution control requirements becoming constantly more stringent, it is necessary to reduce $NO_x$ emissions in exhaust gases while maintaining a high turndown ratio. For instance, the South Coast Air Quality Management District has proposed emission regulations for boilers, steam generators and process heaters that would require any units with capacities greater than or equal to 5 MM BTU/hour to limit their discharge of $NO_x$ to 40 PPM and carbon monoxide to 400 PPM at 3 percent oxygen. Even more stringent $NO_x$ emission standards are expected to be proposed and promulgated in the near future. It is expected that in certain parts of the country, $NO_x$ emissions will be required to be less than 25 PPM.

With pollution control requirements becoming increasingly more stringent, it is necessary to decrease $NO_x$ emissions even further than is achieved with presently known combustion apparatuses, while not increasing or while even decreasing the cost of the combustion equipment. A known technique of staged combustion, wherein primary air or initial combustion is at fuel rich conditions and secondary combustion air is added or staged to complete combustion, has been utilized in various combustion apparatuses to reduce $NO_x$ formation. It has previously been thought impractical to utilize staged combustion in a firetube boiler because there is no known way for introducing a secondary stream of air into the Morison tube. The Morison tube and outer shell of a firetube boiler comprise a pressure vessel which cannot be penetrated to introduce a second stream of air.

U.S. Pat. No. 4,565,137 to Wright discloses an apparatus for supplying four streams of air into a cyclonic combustion vessel connected to a firetube boiler for staged combustion of biomass materials. However, the disclosed apparatus is concerned with providing an increased rate of heat transfer from the flame to the Morison tube and minimizing slag formation in the combustion process. There is no disclosure in Wright of reducing $NO_x$ emissions to an ultra-low level, i.e., less than 25 PPM. To the contrary, the disclosed apparatus results in a high concentration of $NO_x$ in the exhaust gases. Wright increases the luminosity and emissivity of the flame to achieve an increased heat transfer rate. This increase in the flame temperature actually increases $NO_x$ emissions. Wright cannot produce the ultra-low $NO_x$ emissions that are obtained by the present invention.

There are approximately 250,000 existing firetube boilers in the United States and abroad. In their existing condition, these boilers are unable to meet the more stringent pollution control requirements currently being proposed. Therefore, in addition to the need for an apparatus to be used on new firetube boilers for reducing $NO_x$ emissions, a need exists for an apparatus which can be retrofitted onto existing firetube boilers for lowering their $NO_x$ emissions. In addition to the problem with providing staged combustion in a firetube boiler previously discussed, i.e., there is no known way for introducing a second stream of air into the Morison tube, other problems will be encountered in attempting to retrofit existing firetube boilers with an apparatus for staged combustion. For instance, the apparatus must be able to be fit onto the front flange of the boiler without cutting or welding any part of the pressure vessel, i.e., the Morison tube or the shell.

SUMMARY OF THE INVENTION

The present invention overcomes the problems and disadvantages of the prior art by providing an apparatus for staged combustion inside the Morison tube of a firetube boiler, the apparatus decreasing substantially the concentration of $NO_x$ in the exhaust gases.

One object of the present invention to provide an apparatus which can be retrofitted onto existing firetube boilers for providing staged combustion inside the Morison tube.

It is another object of the present invention to provide a combustion apparatus having a high specific heat release, that can operate at relatively low combustion temperatures and with a relatively low percentage of excess air to produce very low $NO_x$ emissions.

It is yet another object of the present invention to provide a combustion apparatus that may be produced at a reduced cost and be capable of stable combustion at relatively low flame temperatures.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

To achieve the foregoing objects in accordance with the invention as embodied and broadly described herein, there is provided a combustion apparatus for minimizing the formation of $NO_x$. The apparatus comprises an elongated combustion vessel having along its length a first and a second combustion portion for sub-stoichiometric and above-stoichiometric combustion respectively. The first and second combustion portions are in communication and the combustion vessel includes a substantially cylindrical wall. There is further provided means for supplying fuel and means for supplying a first stream of air into the first portion of the combustion vessel in an amount sufficient to form a fuel rich ratio for sub-stoichiometric combustion within the first portion of the combustion vessel. Means for tangentially supplying a second stream of air into the second combustion portion of the combustion vessel are provided to mix with the sub-stoichiometric combustion product gases and create a swirling flow pattern. Additionally, means are further provided for forming a cyclonic flow pattern of hot gases within at least one of the first and second combustion portions of the combustion vessel. Heat exchange means surround at least the second portion of the combustion vessel for maintaining the temperature in the combustion vessel at less than about 2000° F. throughout its operation.

In another aspect of the present invention there is provided a combustion apparatus comprising a combustion vessel having first and second spaced opposite ends and a substantially cylindrical longitudinally extending wall. An elongated orifice is connected to the combustion vessel adjacent the second end thereof. There is further provided a combustion chamber having a front end, a rear end and a longitudinally extending wall. The elongated orifice is connected to the combustion chamber adjacent the combustion chamber front end. Means are provided for supplying fuel into the combustion vessel adjacent the first end thereof. Additionally, means are provided for tangentially supplying a first stream of air into the combustion vessel and for forming a cyclonic flow pattern of hot gases for sub-stoichiometric combustion within the combustion vessel. The combustion vessel is dimensioned and configured to effect a cyclonic flow pattern having a Swirl number of at least 0.6 and a Reynolds number of at least 18,000. The combustion product gases formed by the sub-stoichiometric combustion flow from the combustion vessel through the elongated orifice into the combustion chamber. Means are provided for tangentially supplying a second stream of air into the orifice adjacent the front end of the combustion chamber and for forming a swirling air flow within the orifice and the combustion chamber for above-stoichiometric combustion therein. Heat exchange means surround and extend substantially throughout the axial length of the combustion chamber for absorbing heat and cooling the combustion gases therein.

In still another aspect of the present invention, there is provided a combustion apparatus comprising a combustion vessel having first and second spaced opposite ends and a substantially cylindrical longitudinally extending wall. A combustion chamber is provided having a front end, a rear end and a substantially cylindrical longitudinally extending wall. The combustion vessel is fixed to the combustion chamber with the second end of the combustion vessel inserted into the front end of the combustion chamber. Means are provided for supplying fuel into the combustion vessel adjacent the first end thereof. Additionally, means are provided for supplying a first stream of air into the combustion vessel and for forming a swirling air flow within the combustion vessel for sub-stoichiometric combustion therein. Means are also provided for allowing the combustion product gases generated within the combustion vessel to flow from the vessel to the front end of the combustion chamber. A substantially cylindrical exit throat is provided at the rear end of the combustion chamber and is aligned substantially concentrically therewith for exhausting hot gases from the combustion chamber. The exit throat has a diameter less than the diameter of the inner surface of the combustion chamber wall. Means are provided for tangentially supplying a second stream of air into the combustion chamber and for forming a cyclonic flow pattern of hot gases for above-stoichiometric combustion within the chamber. The combustion chamber and exit throat are dimensioned and configured to effect a cyclonic flow pattern having a Swirl number of at least 0.6 and a Reynolds number of at least 18,000. Heat exchange means surround and extend substantially throughout the axial length of the combustion chamber for absorbing heat and cooling the combustion gases therein.

In yet another aspect of the present invention, there is provided a combustion apparatus comprising a combustion chamber having a front end, a rear end and a substantially cylindrical longitudinally extending wall. Means are provided for tangentially supplying fuel into the combustion chamber adjacent the front end thereof. Means are also provided for supplying first and second streams of air into the combustion chamber at spaced intervals along the axial length of the combustion chamber for sub-stoichiometric and above-stoichiometric combustion, respectively, within the combustion chamber and for forming a swirling flow pattern of hot gases for combustion within the combustion chamber. Heat exchange means surround and extend substantially throughout the axial length of the combustion chamber for absorbing heat and cooling the combustion gases therein.

It is to be understood that both the foregoing general description and the following detailed description are exemplary and explanatory only and are not restrictive of the invention as claimed.

The accompanying drawings, which are incorporated in and constitute a part of the specification, illustrate preferred embodiments of the invention and, together with the general description given above and the detailed description of the preferred embodiments given below, serve to explain the principles of the invention.

BRIEF DESCRIPTION OF THE DRAWINGS

FIG. 1(*a*) is an enlarged fragmentary side view in cross-section of a portion of the orifice and secondary plenum chamber shown in FIG. 1;

DESCRIPTION OF THE PREFERRED EMBODIMENTS

Figure 1:
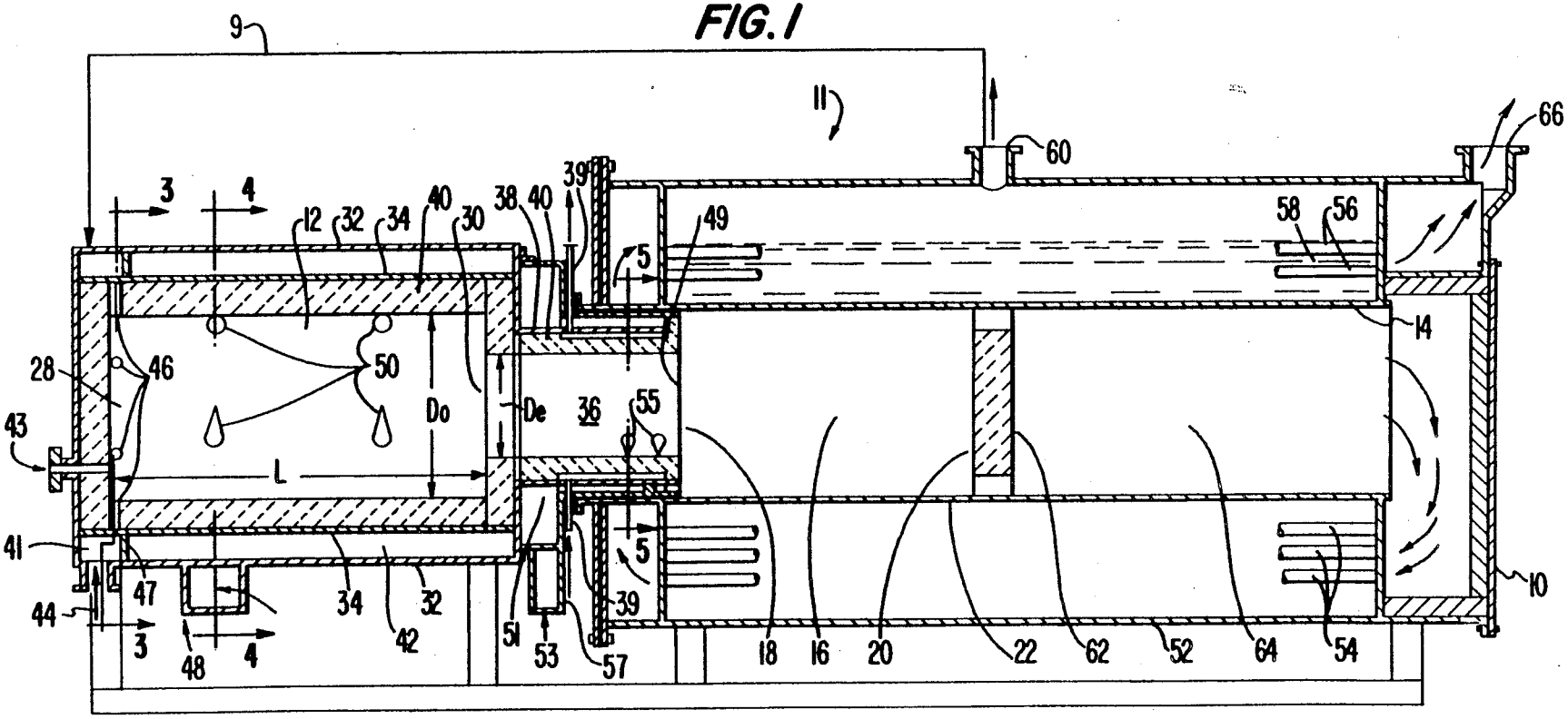
FIG. 1 is a side elevational view in a cross section of a first embodiment of a firetube boiler incorporating the teachings of the present invention.

Reference will now be made in detail to the present preferred embodiments of the invention as illustrated in the accompanying drawings. Although the present invention is particularly useful for firetube boilers, it must be clearly understood at the outset that the present invention is not limited to firetube boilers. Rather, all embodiments of the present invention may be used with a variety of other types of boilers, such as watertube boilers. The firetube boiler shown in the accompanying drawings is a Scotch Marine type boiler.

The inventor of the present invention has been involved in developing an efficient combustion apparatus which produces acceptable levels of $NO_x$ concentrations. It has previously been found that stable combustion and high turndown ratios can be achieved by not cooling the walls of a cyclone combustion chamber in the portion of the chamber into which air and fuel are injected for combustion, as is disclosed in U.S. patent application Ser. No. 928,096, filed Nov. 7, 1986, abandoned, and assigned to a common assignee, which is incorporated herein by reference. The high wall temperatures near the chamber fuel and air entrance achieved when the walls are not cooled enable a high turndown ratio to be achieved. For example, by incorporating uncooled refractory lined walls at the air and fuel entrance to the combustion chamber, the turndown ratio can be increased from 4:1 up to and higher than 10:1. With such an arrangement, excess air over that required as a combustion reactant can be decreased from about 25–30 percent to about 5 percent and kept constant at about 5 percent over the turndown ratio of 10:1. In addition, the flame temperature can be decreased from about 3000° F. for conventional firetube boilers to about 2000° F. By lowering the excess air and the flame temperature, $NO_x$ emission concentrations are decreased in the flue exhaust.

The combustion apparatus embodied in Ser. No. 928,096 is capable of producing exhaust gases having 70 PPM $NO_x$. However, experiments have shown that this combustion apparatus produces such exhaust gases only when a high tangential air velocity is used. The high tangential air velocity, however, provides a high heat flux to the Morison tube of the boiler. Additionally, to obtain the high air velocity a high powered blower motor is required, and this results in an increase in capital costs. To overcome these problems, a lower tangential air velocity and a higher length/diameter ratio in the combustion chamber have been used. These measures have increased the $NO_x$ emissions in the exhaust gases to 120–130 PPM. The increase in the concentration of $NO_x$ is believed to be a direct result of the relatively high refractory skin temperature in the uncooled portion of the combustion chamber.

It has been found that the concentration of $NO_x$ formed by combustion can be further reduced in a boiler furnace which is acting as a cyclonic combustion chamber, as is disclosed in U.S. patent application Ser. No. 044,735, filed May 1, 1987 U.S. Pat. No. 4,860,695 and assigned to a common assignee, which is incorporated herein by reference. This application discloses a non-adiabatic combustor comprising a boiler furnace, such as the firetube in a firetube boiler. It was anticipated that the absence of the front refractory lined portion used in Ser. No. 928,096 would reduce $NO_x$ formation because the entire combustion chamber would be surrounded by heat exchange means, such as those used in the firetube boiler. Tests conducted with the combustion apparatus embodied in Ser. No. 044,735 have shown that combustion gases generated therein contain below 60 PPM but higher than 40 PPM of $NO_x$.

The present invention represents the present status of the inventor's and his employer's effort to produce an efficient combustion appartus that substantially reduces the concentration of $NO_x$ in the exhaust gases. The present invention results in a lower concentration of $NO_x$ in the exhaust gases than in the inventions disclosed in the above applications.

FIG. 1 shows a horizontally disposed firetube boiler 10 and a cyclonic combustion vessel 12 in accordance with a first embodiment of the combustion apparatus of the present invention. This apparatus is designated generally by the reference numeral 11. Firetube boiler 10 includes a central firetube 14 also known as a Morison tube, with a combustion chamber 16.

In accordance with the present invention, there is provided a combustion apparatus including a combustion vessel having first and second spaced opposite ends and a substantially cylindrical longitudinally extending wall. As embodied herein, combustion apparatus 11 includes combustion vessel 12 having first and second spaced opposite ends 28 and 30, respectively, and a substantially cylindrical longitudinally extending wall including outer shell 32 and inner shell 34. Inner shell 34 is lined with refractory material 40.

In accordance with the present invention, the combustion apparatus includes an elongated orifice connected to the combustion vessel adjacent the second end thereof. As embodied herein, combustion apparatus 11 includes an elongated orifice 36 connected to the second end 30 of combustion vessel 12. Elongated orifice 36 includes an inner surface 38 lined with refractory material 40.

In accordance with the present invention, the combustion apparatus includes a combustion chamber having a front end, a rear end, and a longitudinally extending wall. The elongated orifice 36 is connected to the combustion chamber adjacent the combustion chamber front end. As embodied herein, combustion apparatus 11 includes combustion chamber 16 having a front end 18, a rear end 20 and a longitudinally extending wall 22. Elongated orifice 36 is connected to the front end 18 of combustion chamber 16. Orifice 36 is water cooled to reduce the refractory skin temperature. As shown in FIGS. 1, 1(*a*) and 5, water is supplied to annulus 45 through water inlet 37 for cooling the refractory material 40 that is lining orifice inner surface 38. The water exits through water outlet 39.

Figure 3:
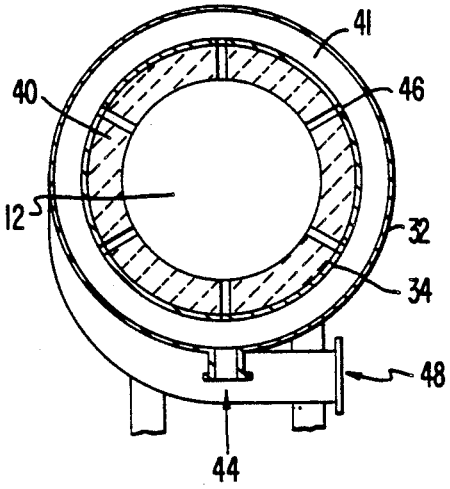
FIG. 3 is a cross-sectional view taking along the line 3—3 of FIG. 1.
Figure 1A:
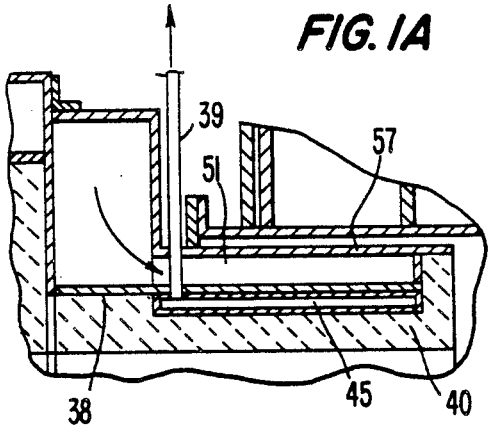

In accordance with the present invention, the combustion apparatus includes means for supplying fuel into the combustion vessel adjacent the first end thereof. As embodied herein, the means for supplying fuel into combustion vessel 12 includes fuel plenum chamber 41, which is an annulus between inner and outer shells 34 and 32, respectively, of combustion vessel 12. As shown in FIG. 3, fuel plenum chamber 41 includes a fuel inlet 44 and a plurality of radially spaced fuel nozzles 46 communicating with combustion vessel 12. As shown in FIG. 3, fuel nozzles 46 supply fuel radially into combustion vessel 12. Alternatively, the fuel nozzles may supply the fuel tangentially into the combustion vessel. The fuel nozzles are preferably positioned adjacent the first end 28 of combustion 12 and are spaced about the circumference of the vessel. Fuel inlet 44 is utilized when natural gas is combusted. When fuel oil or highly beneficiated coal is combusted, these fuels are axially supplied into combustion vessel 12 through inlet 43 shown in FIG. 1.

Figure 4:
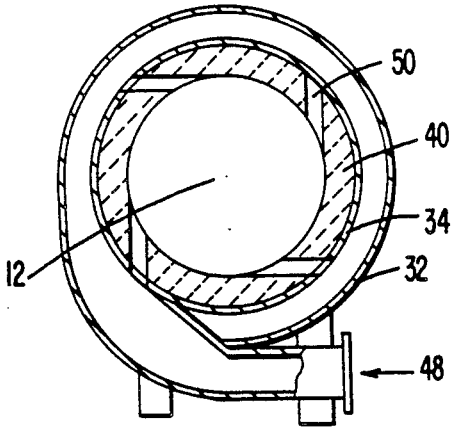
FIG. 4 is a cross-sectional view taken along the line 4—4 of FIG. 1.

In accordance with the present invention, the combustion apparatus includes means for tangentially supplying a first stream of air into the combustion vessel and for forming a cyclonic flow pattern of hot gases for sub-stoichiometric combustion within the combustion vessel. The combustion vessel is dimensioned and configured to effect a cyclonic flow pattern having a Swirl number of at least 0.6 and a Reynolds number of at least 18,000. The combustion product gases formed by the sub-stoichiometric combustion flow from the combustion vessel through the elongated orifice into the combustion chamber. As embodied herein, the means for supplying air into combustion vessel 12 includes primary plenum chamber 42, which is an annulus between inner and outer shells 34 and 32, respectively, of combustion vessel 12. As shown in FIG. 4, primary plenum chamber 42 has an air inlet 48 and a plurality of radially spaced primary tangential air nozzles 50 communicating with combustion vessel 12. These nozzles are spaced along the axial length of the combustion vessel and about the circumference of the vessel. Annular partition 47 separates fuel inlet 44 in fuel plenum chamber 41 and air inlet 48 in primary plenum chamber 42.

Combustion vessel 12 is dimensioned and configured to effect a cyclonic flow pattern having a Swirl number of at least 0.6 and a Reynolds number of at least 18,000. It is well known in the art how to construct a combustion vessel for cyclonic combustion. The major cyclone combustor geometrical characteristics such as inside diameter ($D_o$), length (L) and exit diameter (De) (illustrated in FIG. 1) should be designed properly to achieve acceptable cyclone performance based on established cyclone criteria of a Swirl number of at least 0.6 and a Reynolds number of at least 18,000. These minimum values should be sufficient to provide gas recirculation inside cyclone combustion vessel 12, good fuel and air mixing and stable combustion. Combustion vessel 12 will, during operation, exhibit large internal reverse flow zones with as many as three concentric toroidal recirculation zones being formed.

Figure 5:
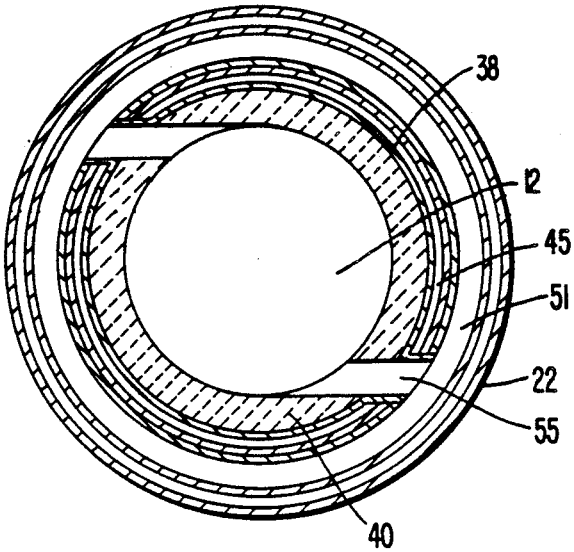
FIG. 5 is a cross-sectional view taken along the line 5—5 of FIG. 1.

In accordance with the present invention, the combustion apparatus includes means for tangentially supplying a second stream of air into the orifice adjacent the front end of the combustion chamber and for forming a swirling air flow within the orifice and the combustion chamber for above-stoichiometric combustion therein. As embodied herein, means for supplying air into orifice 36 includes secondary plenum chamber 51 fixed to and surrounding orifice 36. Secondary plenum chamber 51 includes a metal shell 57, an air inlet 53 and a plurality of radially spaced secondary tangential air nozzles 55 communicating with orifice 36. With reference to FIGS. 1 and 1(*a*), it can be seen that water inlet 37 and water outlet 39 extend through metal shell 57 of secondary plenum chamber 51. As shown in FIG. 5, secondary tangential air nozzles 55 extend through annulus 45 and refractory material 40 to provide air from secondary plenum chamber 51 to orifice 36. As shown, nozzles 55 are located adjacent the exit end 49 of orifice 36 and are spaced about the inner circumference thereof.

Orifice 36 provides a relatively short combustion residence time, yet provides a good mixing of the substantially combustible gases and the secondary air stream for intensive combustion. The secondary combustion begins at the exit end 49 of orifice 36 and continues in combustion chamber 16 in the form of a swirling flame. It is desirable to have the majority of the above-stoichiometric combustion occurring in combustion chamber 16. The length and shape of the flame depend upon the following features: (1) velocity and swirling intensity of the combustible gases in orifice 36; (2) secondary air velocity in nozzles 55; (3) shape of the confinement, i.e., boiler furnace, where the flame is located; and (4) the presence of a device in combustion chamber 16 which would maintain or intensify the swirling flow.

In accordance with the present invention, the combustion apparatus includes heat exchange means surrounding and extending substantially throughout the axial length of the combustion chamber for absorbing heat and cooling the combustion gases in the chamber. As embodied herein and as shown in FIG. 1, combustion chamber 16 is integral with firetube boiler 10, and the heat exchange means includes an outer shell 52 surrounding combustion chamber 16 and a plurality of spaced gas tubes 54 and 56 for conducting hot gases from combustion chamber 16. Gas tubes 54 and 56 are disposed between outer shell 52 and combustion chamber wall 22. The heat exchange means further includes the space 58 between shell 52 and combustion chamber wall 22 and exterior of gas tubes 54 and 56 for containing a cooling fluid. Cooling fluid in space 58 cools cylindrical wall 22 of combustion chamber 16 and the gas tubes 54 and 56. When the cooling fluid is water, steam is exhausted from space 58 through port 60. The present invention is not intended to be limited to the specific heat exchange means described. Other heat exchange means used on boiler furnaces are considered acceptable alternatives.

Figure 2:
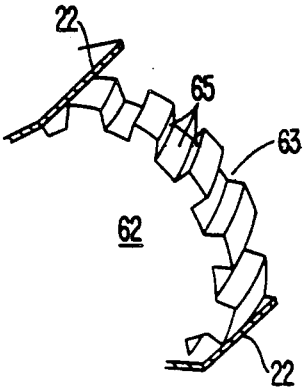
FIG. 2 is a fragmentary view in perspective of the gas swirler shown in FIG. 1.

Preferably, combustion apparatus 11 further includes a combustion gas swirler 62 disposed in firetube 14 at the rear end 20 of combustion chamber 16. A substantially cylindrical cooling chamber 64 extends axially beyond the rear end 20 of combustion chamber 16 and is substantially longitudinally aligned with combustion chamber 16. In effect, swirler 62 separates firetube 14 into combustion chamber 16 and cooling chamber 64. The structure of gas swirler 62 is shown in FIG. 2 and is fully disclosed in U.S. patent application Ser. No. 118,933, filed Nov. 10, 1987 and assigned to a common assignee, which is incorporated herein by reference.

As shown in FIG. 2, gas swirler 62 comprises a plurality of radially spaced slots 63 at the rear end 20 of combustion chamber 16 for directing the swirling hot combustion gases out of combustion chamber 16 in a direction substantially tangential to combustion chamber wall 22. Swirler 62 intensifies the swirling flow in combustion chamber 16 providing an increased heat transfer rate which lowers the temperature in chamber 16 amd results in decreased $NO_x$ emissions. Swirler 62 is preferably formed of a retractory material. Each slot 63 has three refractory walls 65. The Morison tube 14 engages the outer surface of the swirler 62 and with the walls 65 forms the slots 63. High temperature gases from combustion chamber 16 pass through slots 63 into cooling chamber 64. Due to the high gas velocity in slots 63, there is a high heat transfer coefficient. Accordingly, a temperature reduction in the gases entering cooling chamber 64 results. Additionally, the high velocity and high Swirl number of the gases passing through slots 63 result in a high heat transfer coefficient in cooling chamber 64. This increased heat transfer rate reduces the temperature of gases exhausted from cooling chamber 64. This reduced temperature results in decreased $NO_x$ emissions in the flue exhaust.

The first plurality of gas tubes 54 and the second plurality of gas tubes 56 extend parallel to the axis of Morison tube 14. The first plurality of gas tubes 54 are in communication at one end with an end of cooling chamber 64 and at the opposite end with a chamber which in turn is in communication with second plurality of gas tubes 56. The gas tubes 56 are in turn in communication at their opposite ends with an exhaust flue 66 that exhausts gases from tubes 56. The arrows in FIG. 1 indicate the direction of gas flow, as is conventionally known for firetube boilers.

The operation of the first embodiment of the present invention will now be described. Combustion vessel 12 is an adiabatic vessel in which the first stage of a two-stage combustion process occurs. The primary air entering combustion vessel 12 through tangential nozzles 50 mixes with the fuel entering through radial nozzles 46 in a fuel rich ratio. Consequently, incomplete/sub-stoichiometric cyclonic combustion occurs.

The first embodiment of the invention is adapted for combustion natural gas, fuel oil, or highly beneficiated coal. Highly beneficiated coal is coal that has been ground to an average size of 40 microns and from which substantially all the ash and sulfur has been removed by known techniques.

The first stage combustion occuring in combustion vessel 12 combusts the fuel to substantially combustible gases (mainly CO and $H_2$). The combustion product gases formed by the sub-stoichiometric combustion flow from combustion vessel 12 through elongated orifice 36 into combustion chamber 16. A sufficient flow of secondary air entering through tangential nozzles 55 is mixed with the substantially combustible gases flowing through orifice 36 so that above-stoichiometric combustion occurs at the exit end 49 of orifice 36 and in combustion chamber 16. The secondary air is supplied tangentially into orifice 36 to maximize the swirling flow pattern of hot gases for increasing the heat transfer rate to combustion chamber wall 22. The secondary air is supplied as close as possible to the exit end 49 of orifice 36 to minimize the combustion occurring in orifice 36 and maximize the combustion occurring in combustion chamber 16. The combustion gases generated in chamber 16 flow through slots 63 formed by swirler 62 into cooling chamber 64. Subsequently, the combustion gases enter the first plurality of gas tubes 54 and flow into the second plurality of gas tubes 56 as indicated by the arrows in FIG. 1. The cooled combustion gases flow through the second plurality of gas tubes 56 and exit through exhaust flue 66.

Figure 6:
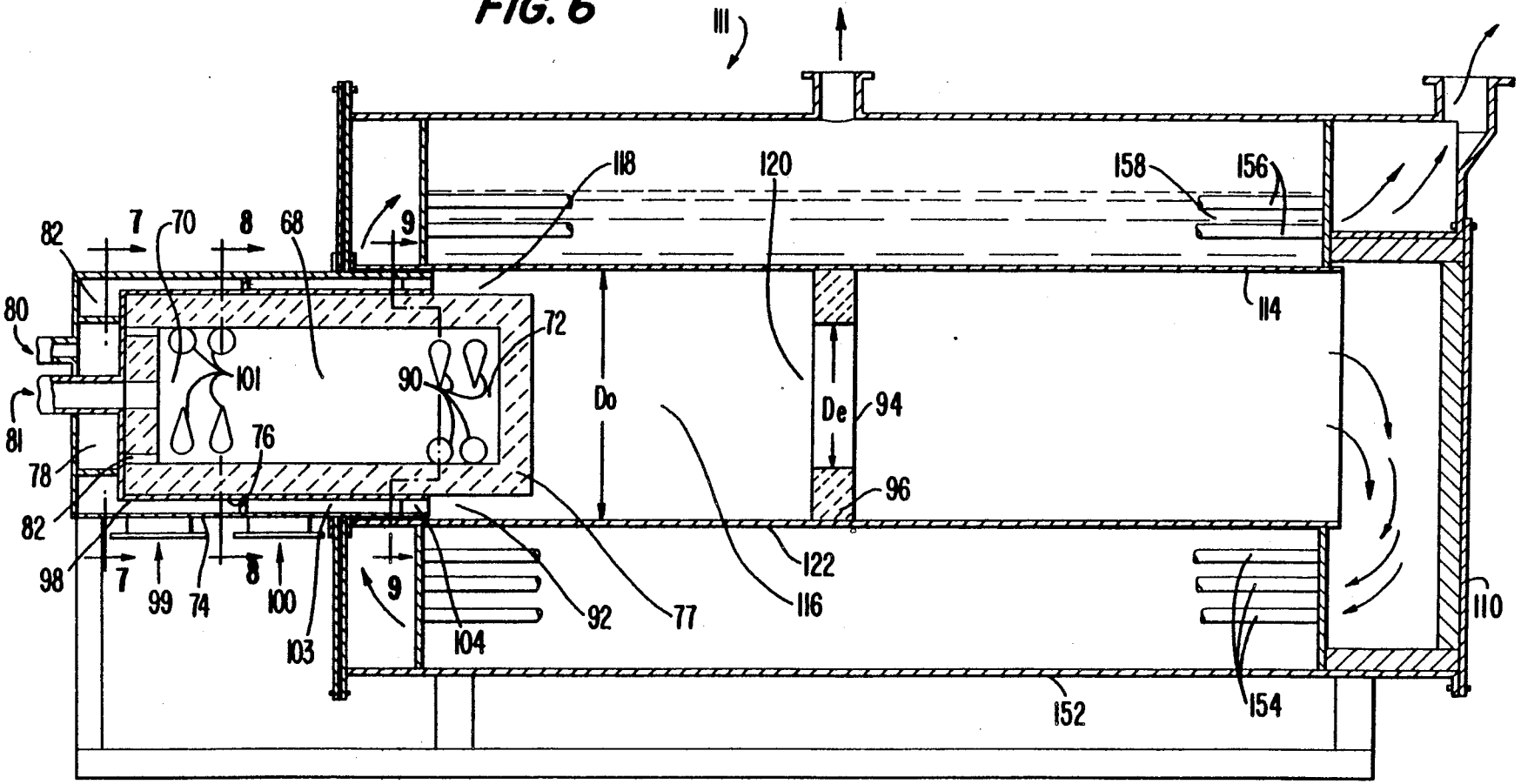
FIG. 6 is a side elevational view in cross section of a second embodiment of a firetube boiler incorporating the teachings of the present invention.

A second embodiment of the present invention will now be described with reference to FIGS. 6 through 9. FIG. 6 shows a horizontally disposed firetube boiler 110 and a combustion vessel 68 in accordance with a second embodiment of the combustion apparatus designated generally by the reference numeral 111. Firetube boiler 110 includes a central firetube 114, with a combustion chamber 116.

In accordance with the present invention, there is provided a combustion apparatus including a combustion vessel having first and second spaced opposite ends and a substantially cylindrical longitudinally extending wall. As embodied herein, combustion apparatus 111 includes combustion vessel 68 having first and second spaced opposite ends 70 and 72, respectively, and a substantially cylindrical longitudinally extending wall including outer shell 74 and inner shell 76. Inner surface 76 is lined with refractory material 77.

In accordance with the present invention, the combustion apparatus includes a combustion chamber having a front end, a rear end, and a substantially cylindrical longitudinally extending wall. The combustion vessel is fixed to the combustion chamber with the second end of the combustion vessel inserted into the front end of the combustion chamber. As embodied herein, combustion apparatus 111 includes combustion chamber 116 having a front end 118, a rear end 120 and a substantially cylindrical longitudinally extending wall 122. Combustion vessel 68 is fixed to combustion chamber 116 with the second end 72 of combustion vessel 68 inserted into the front end 118 of combustion chamber 116. As shown in FIG. 6, refractory material 77 extends further into combustion chamber 116 than inner and outer shells 76 and 74, respectively.

In accordance with the present invention, the combustion apparatus includes means for supplying fuel into the combustion vessel adjacent the first end thereof. As embodied herein, the fuel supply means includes a fuel plenum chamber 78 having a fuel inlet 80 and a plurality of radially spaced fuel nozzles 82 for axially injecting fuel into combustion vessel 68. The second embodiment of the invention is adapted for combusting natural gas, fuel oil, or highly beneficiated coal. Fuel inlet 80 is utilized when natural gas is combusted. When fuel oil or highly beneficiated coal is combusted, these fuels are axially supplied in combustion vessel 68 through inlet 81 as shown in FIG. 6.

Figure 7:
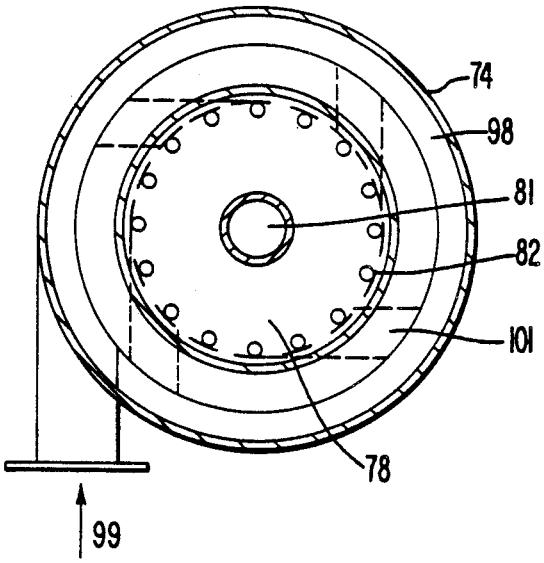
FIG. 7 is a cross-sectional view taken along the line 7—7 of FIG. 6.
Figure 8:
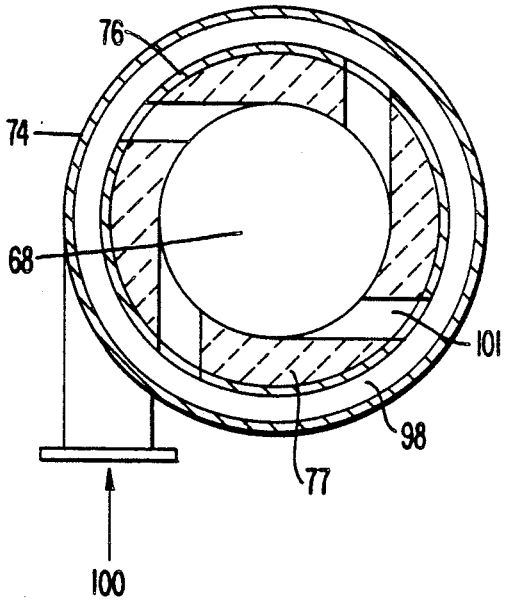
FIG. 8 is a cross-sectional view taken along the line 8—8 of FIG. 6.

In accordance with the present invention, the combustion apparatus includes means for tangentially supplying a first stream of air into the combustion vessel and for forming a swirling air flow within the combustion vessel for sub-stoichiometric combustion therein. As embodied herein, the means for supplying primary air into combustion vessel 68 includes plenum chamber 98, which is an annulus between inner and outer shells 76 and 74, respectively, of combustion vessel 68. As shown in FIGS. 7 and 8, plenum chamber 98 includes a primary air inlet 99 and a plurality of radially spaced primary tangential air nozzles 101 for supplying air into combustion vessel 68 for mixing with the fuel in a fuel rich ratio. Consequently, incomplete/sub-stoichiometric combustion occurs. The first stage combustion occurring in combustion vessel 68 combusts the fuel to substantially combustible hot gases CO and $H_2$.

In accordance with the present invention, the combustion apparatus includes means for allowing the combustion product gases generated within the combustion vessel to flow from the vessel to the front end of the combustion chamber. As embodied herein, the means for allowing the combustion product gases to flow from combustion vessel 68 to combustion chamber 116 comprises a plurality of radially spaced outlet nozzles 90 disposed in the refractory material 77 adjacent second end 72 of combustion vessel 68. Outlet nozzles 90 are in communication with combustion chamber 116 and are tangential to combustion vessel 68. As shown in FIG. 6, an annular space 92 is formed between refractory material 77 of combustion vessel 68 and combustion chamber wall 122. Outlet nozzles 90 supply the combustion product gases in annular space 92 and create a swirling air flow therein.

In accordance with the present invention, the combustion apparatus includes a substantially cylindrical exit throat at the rear end of the combustion chamber and aligned substantially concentrically therewith for exhausting hot gases from the combustion chamber. The exit throat has a diameter less than the diameter of the inner surface of the combustion chamber wall. As embodied herein, combustion apparatus 111 includes a substantially cylindrical exit throat 94 at the rear end 120 of combustion chamber 116 and aligned substantially concentrically therewith for exhausting hot gases from combustion chamber 116. Exit throat 94 has a diameter less than the diameter of combustion chamber wall 122. The ratio of the diameter of exit throat 94 (De) to the diameter of combustion chamber wall 122 (Do), i.e., De/Do, is preferably within the range of 0.4 to about 0.7 in order to achieve the desired cyclonic air flow within combustion chamber 116. Rear end wall 96 is preferably comprised of a refractory material.

Figure 9:
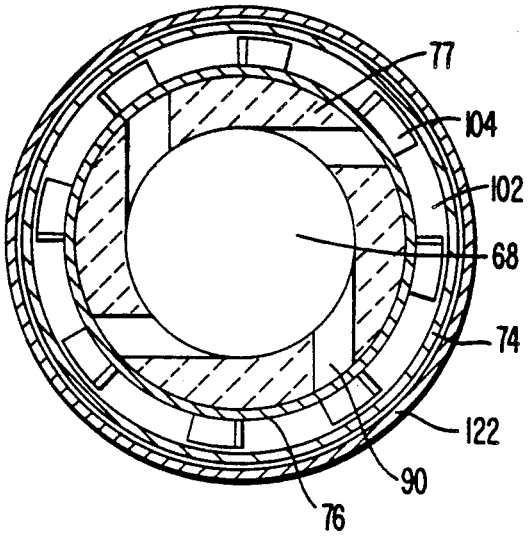
FIG. 9 is a cross-sectional view taken along the line 9—9 of FIG. 6.

In accordance with the present invention, the combustion apparatus includes means for tangentially supplying a second stream of air into the combustion chamber and for forming a cyclonic flow pattern of hot gases for above-stoichiometric combustion within the chamber. The combustion chamber and exit throat are dimensioned and configured to effect a cyclonic flow pattern within the combustion chamber having a Swirl number of at least 0.6 and a Reynolds number of at least 18,000. As embodied herein, the means for supplying air into combustion chamber 116 includes plenum chamber 103, which is an annulus between inner and outer shells 76 and 74, respectively, of combustion vessel 68. Plenum chamber 103 includes a secondary air inlet 100 and a plurality of radially spaced air vanes 104 for supplying air tangentially into annular space 92 for mixing with the sub-stoichiometric combustion product gases. As shown in FIG. 9, a plurality of radially spaced angular slots 102 through which secondary air is supplied are defined by air vanes 104. Angular slots 102 and air vanes 104 provide for enhanced combustion and heat transfer to combustion chamber wall 122. Combustion chamber 116 and exit throat 96 are dimensioned and configured to effect a cyclonic flow pattern within combustion chamber 116 having a Swirl number of at least 0.6 and a Reynolds number of at least 18,000.

Combustion chamber 116 will, during operation, exhibit large internal reverse flow zones with as many as three concentric toroidal recirculation zones being formed. Such recirculation zones are known generally in the field of conventional cyclone combustors. It is the cyclonic turbulence which enables the achievement of specific heat release values up to and higher than $3.5\times10^6$ Kcal per cubic meter per hour. The high level of turbulence results in significantly improved heat exchange and, therefore a relatively uniform temperature throughout combustion chamber 116.

In accordance with the present invention, the combustion apparatus includes heat exchange means surrounding and extending substantially throughout the axial length of the combustion chamber for absorbing heat and cooling the combustion gases in the chamber. As can be seen in FIG. 6, the heat exchange means of the second embodiment of the invention are the same as the heat exchange means of the first embodiment. Namely, outer shell 152, a first and second plurality of spaced gas tubes 154 and 156, respectively, and space 158 for containing a cooling fluid.

The operation of the second embodiment of the present invention will now be described. Combustion vessel 68 is an adiabatic vessel in which the first stage of a two-stage combustion process occurs. The primary air entering combustion vessel 68 through nozzles 101 mixes with the fuel entering through nozzles 82 in a fuel rich ratio. Consequently, incomplete/sub-stoichiometric combustion occurs. The first stage combustion occurring in combustion vessel 68 combusts the fuel to substantially combustible gases CO and $H_2$. The combustion product gases formed by the sub-stoichiometric combustion flow from combustion vessel 68 through nozzles 90 into combustion chamber 116. The secondary air entering annular space 92 through angular slots 102 mixes with the substantially combustible gases flowing through nozzles 90 for above-stoichiometric combustion in combustion chamber 116. The exhaust gases having an ultra-low $NO_x$ content flow through tubes 154 and 156 and out through the exhaust port.

Figure 10:
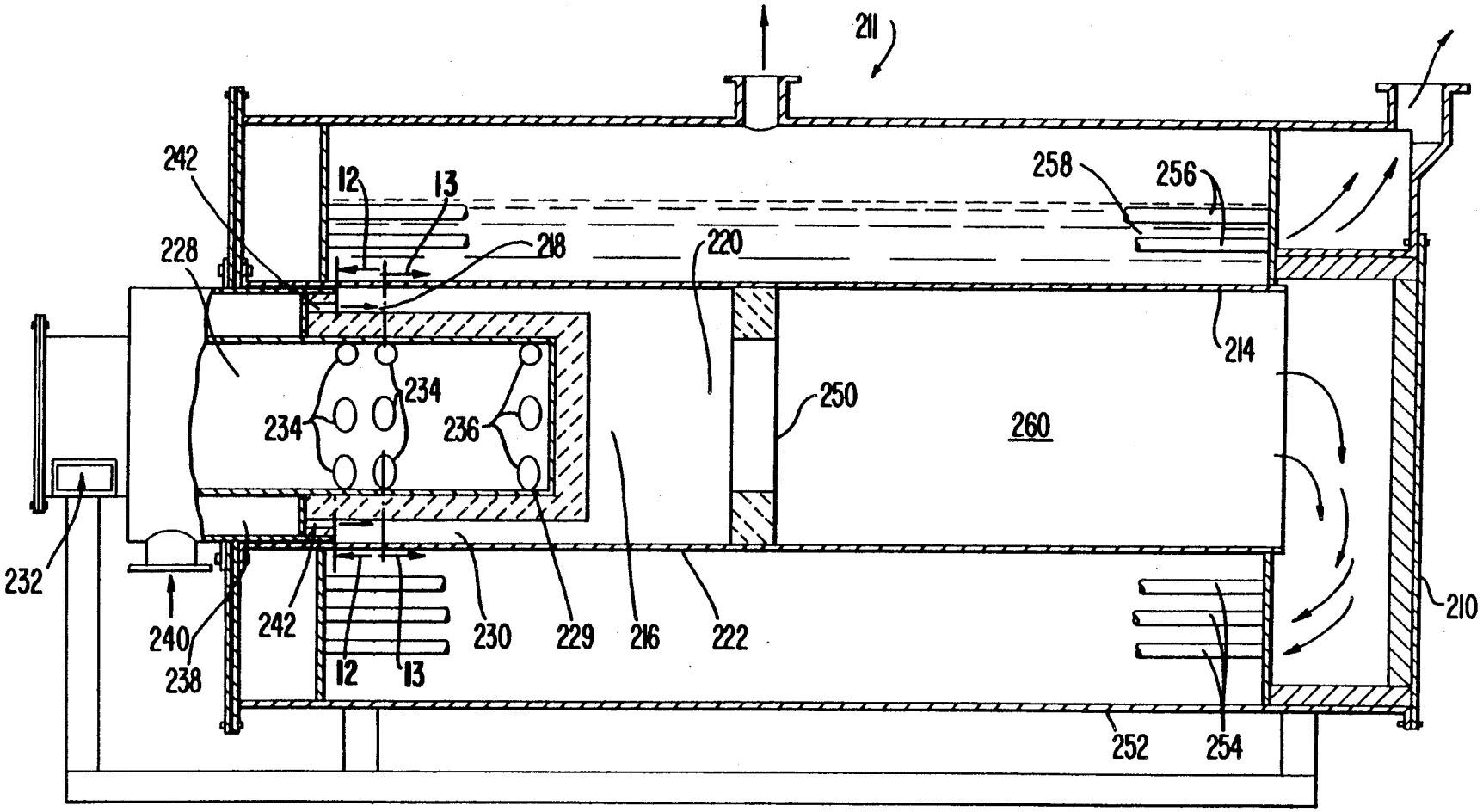
FIG. 10 is a side elevational view in cross section of a third embodiment of a firetube boiler incorporating the teachings of the present invention.
Figure 11:
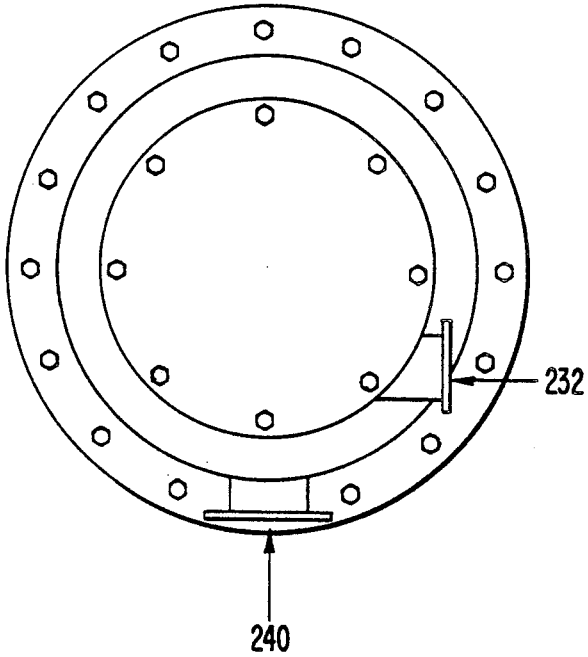
FIG. 11 is a front view of the apparatus shown in FIG. 10.
Figure 12:
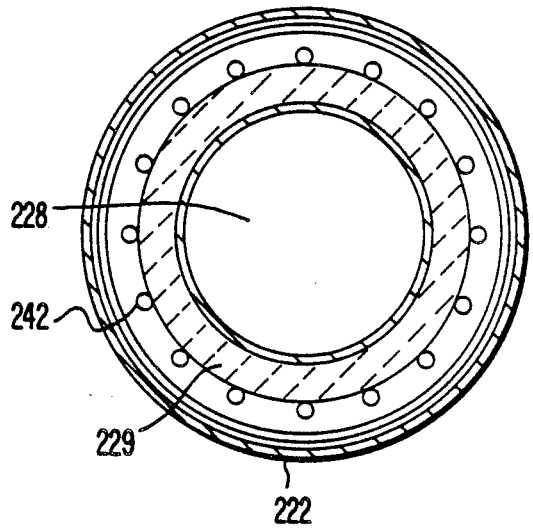
FIG. 12 is a cross-sectional view taken along the line 12—12 of FIG. 10.
Figure 13:
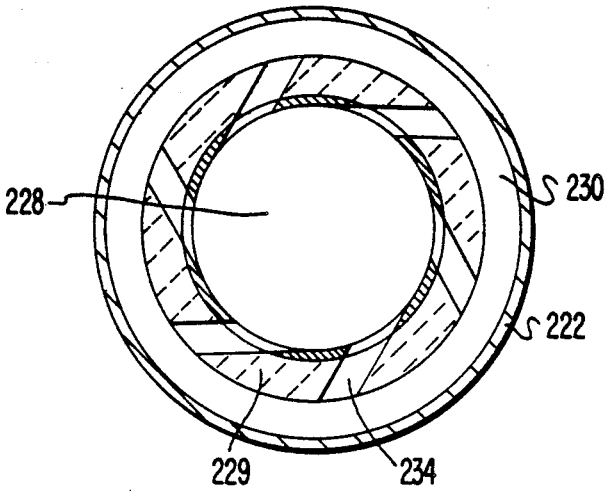
FIG. 13 is a cross-sectional view taken along the line 13—13 of FIG. 10.

A third embodiment of the present invention will now be described with reference to FIGS. 10–13. The third embodiment of the present invention is adapted for combusting natural gas. FIG. 10 shows a horizontally disposed firetube boiler 210 in accordance with a third embodiment of the boiler combustion apparatus designated generally by the reference numeral 211. Firetube boiler 210 includes a central firetube 214, with a combustion chamber 216.

In accordance with the present invention, there is provided a combustion apparatus including a combustion chamber having a front end, a rear end and a substantially cylindrical longitudinally extending wall. As embodied herein, combustion apparatus 211 includes combustion chamber 216 having a front end 218, rear end 220 and a substantially cylindrical longitudinally extending wall 222.

In accordance with the present invention, the combustion apparatus includes means for tangentially supplying a first and second stream of air into the combustion chamber at spaced intervals along the axial length of the combustion chamber for sub-stoichiometric and above-stoichiometric combustion, respectively, within the combustion chamber and for forming a swirling flow pattern of hot gases for combustion within the combustion chamber. As embodied herein, the air supply means comprises an air plenum chamber 228 partially disposed in boiler firetube 214. The portion of air plenum chamber 228 disposed in boiler firetube 214 is covered with refractory material 229. Air plenum chamber 228 has a diameter less than the diameter of combustion chamber 216 for forming an annular space 230 between refractory material 229 and combustion chamber wall 222. Air plenum chamber 228 includes tangential air inlet 232 and a first and second group of radially spaced tangential air nozzles 234 and 236, respectively, disposed in spaced axial relation to each other for supplying the first and second streams of air, respectively, in annular space 230.

In accordance with the present invention, there is provided a combustion apparatus including means for supplying fuel into the combustion chamber adjacent the front end thereof. As embodied herein, the fuel supply means includes a fuel plenum chamber 238 surrounding a portion of air plenum chamber 228 not disposed in boiler firetube 214. Fuel plenum chamber 238 includes fuel inlet 240 and a plurality of radially spaced axial fuel nozzles 242 for supplying fuel axially into annular space 230.

In accordance with the present invention, the combustion apparatus includes heat exchange means surrounding and extending substantially throughout the axial length of the combustion chamber for absorbing heat and cooling the combustion gases in the chamber. As can be seen in FIG. 10, the heat exchange means of the third embodiment of the invention are the same as the heat exchange means of the first and second embodiments of the invention. Namely, outer shell 252, a first and second plurality of spaced gas tubes 254 and 256, respectively, and space 258 for containing a cooling fluid.

In the third embodiment of the present invention, the total air supply is preferably introduced tangentially into hollow plenum chamber 228. Alternatively, the total air supply may be introduced axially into plenum chamber 228. Nozzles 234 supply the primary stream of air into annular space 230 where it mixes with fuel supplied by nozzles 242 in annular space 230 for sub-stoichiometric combustion. The portion of Morison tube 214 adjacent to annular space 230 wherein sub-stoichiometric combustion occurs (to the left of nozzles 236 in FIG. 10) should preferably be coated with a heat resistant and high conductivity coating to withstand the corrosive environment of sub-stoichiometric combustion. The swirling air flow in annular space 230 continues toward the rear end 220 of combustion chamber 216 where it mixes with the secondary air flow supplied in annular space 230 by nozzles 236 for above-stoichiometric combustion in combustion chamber 216.

As shown in FIG. 10, the total air supply is distributed between nozzles 234 and 236 by designing plenum chamber 228 appropriately. The number of nozzles 234, distance between nozzles 234 and 236, amount of air supplied in plenum chamber 228, and the air and fuel velocities affect the fuel reaction rate, combustion temperature and $NO_x$ formation.

The remaining elements beyond the combustion chamber and the operation of these elements are substantially the same as those described with reference to the first and second embodiments.

Figure 14:
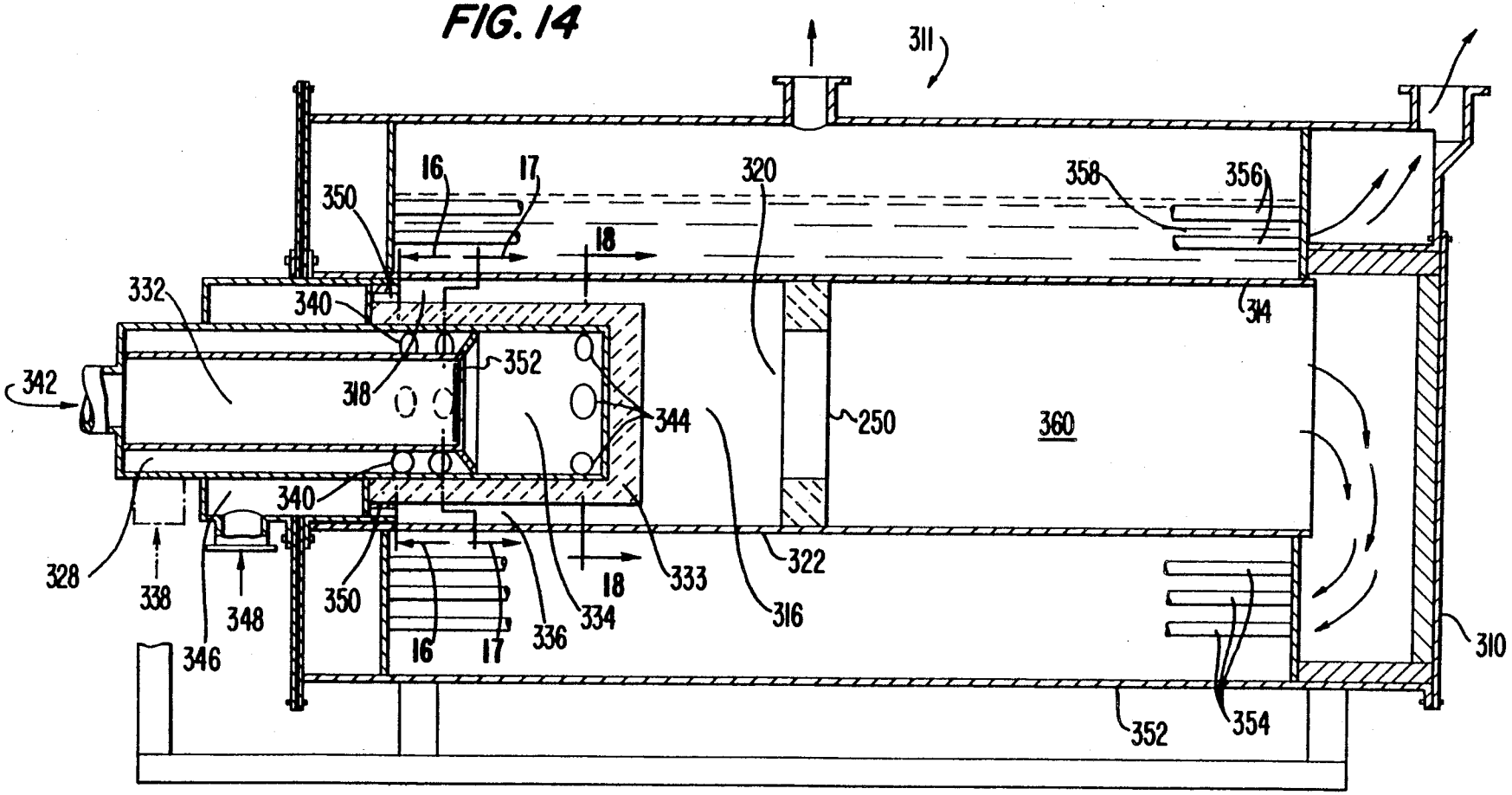
FIG. 14 is a side elevational view in cross section of a fourth embodiment of a firetube boiler incorporating the teachings of the present invention.
Figure 15:
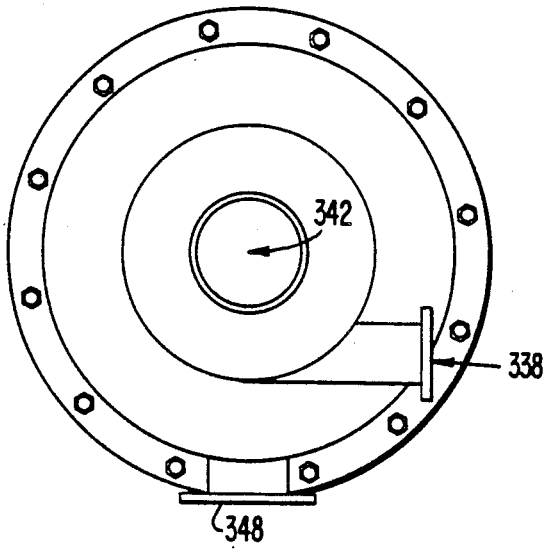
FIG. 15 is a front view of the apparatus shown in FIG. 14.
Figure 16:
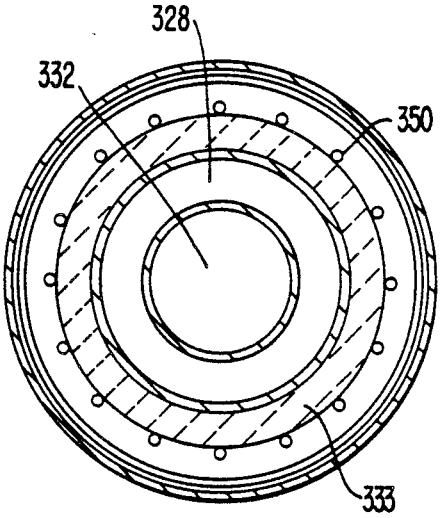
FIG. 16 is a cross-sectional view taken along the line 16—16 of FIG. 14.

A fourth embodiment of the present invention will now be described with reference to FIGS. 14–18. The fourth embodiment of the present invention is adapted for combusting natural gas. FIG. 14 shows a horizontally disposed firetube boiler 310 in accordance with the fourth embodiment of the combustion apparatus designated generally by the reference numeral 311. Firetube boiler 310 includes a central firetube 314, with a combustion chamber 316.

In accordance with the present invention, the combustion apparatus comprises a combustion chamber having a front end, a rear end, and a substantially cylindrical longitudinally extending wall. As embodied herein, the combustion apparatus 311 includes combustion chamber 316 having a front end 318, a rear end 320 and a substantially cylindrical longitudinally extending wall 322.

In accordance with the present invention, the combustion apparatus includes means for tangentially supplying a first and second stream of air separately into the combustion chamber at spaced intervals along the axial length of the combustion chamber for sub-stoichiometric and above-stoichiometric combustion, respectively, within the combustion chamber and for forming a swirling flow pattern of hot gases for combustion within the combustion chamber. As embodied herein, the air supply means includes a primary air plenum chamber 328 and a secondary air plenum chamber disposed coaxially in boiler firetube 314. The portion of the first and second plenum chambers disposed in combustion chamber 316 is covered with refractory material 333. Secondary air plenum chamber includes a first axial portion 332 of a first predetermined diameter and a second axial portion 334 of a second predetermined diameter greater than the first predetermined diameter. Primary air plenum chamber 328 is axially coextensive with first axial portion 332 and has the second predetermined diameter. The second predetermined diameter is less than the diameter of combustion chamber 316 for forming an annular space 336 between combustion chamber wall 322 and refractory material 333. Primary air plenum chamber 328 includes an air inlet 338 and a first group of radially spaced tangential nozzles 340 for supplying the first stream of air in annular space 336. The secondary air plenum chamber includes an air inlet 342 and a second group of radially spaced tangential nozzles 344 for supplying the second stream of air in annular space 336.

In accordance with the present invention, the combustion apparatus includes means for supplying fuel into the combustion chamber adjacent the front end thereof. As embodied herein, the fuel supplying means includes fuel plenum chamber 346 surrounding and fixed to primary air plenum chamber 328. Fuel plenum chamber 346 includes a fuel inlet 348 and a plurality of radially spaced axial fuel nozzles 350 for supplying fuel into annular space 336.

In accordance with the present invention, the combustion apparatus includes heat exchange means surrounding and extending substantially throughout the axial length of the combustion chamber for absorbing heat and cooling the combustion gases in the chamber. As can be seen in FIG. 14, the heat exchange means of the fourth embodiment of the invention are the same as the heat exchange means of the first three embodiments of the invention. Namely, outer shell 352, a first and second plurality of spaced gas tubes 354 and 356, respectively, and space 358 for containing a cooling fluid. As noted earlier, all embodiments of the invention may utilize conventional boiler heat exchange means other than those shown in the accompanying drawings.

Figure 17:
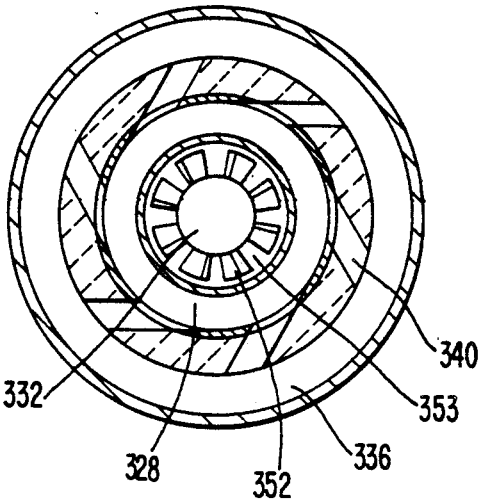
FIG. 17 is a cross-sectional view taken along the line 17—17 of FIG. 14.
Figure 18:
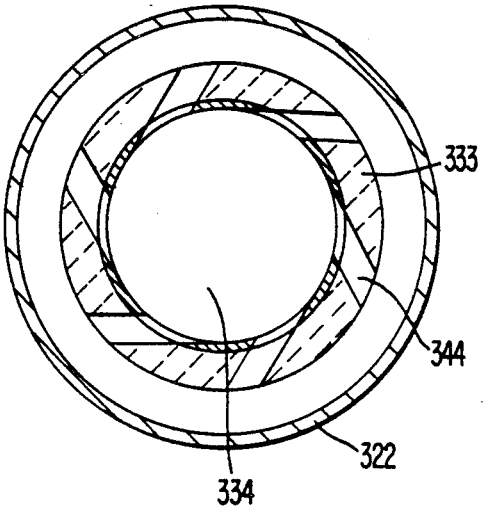
FIG. 18 is a cross-sectional view taken along the line 18—18 of FIG. 14.

The fourth embodiment of the present invention utilizes two separate air flows for better control of the primary and secondary air streams. As shown in FIGS. 14 and 17, primary air enters primary air plenum chamber 328 tangentially through primary air inlet 338 and is supplied into annular space 336 by tangential nozzles 340. The mixing of the primary air and fuel supplied axially into annular space 336 by fuel nozzles 350 and air nozzles 340 results in a fuel-rich ratio which consequently results in sub-stoichiometric combustion occurring in annular space 336. The portion of Morison tube 314 adjacent to annular space 336 wherein sub-stoichiometric combustion occurs is preferably coated with a heat resistant and high conductivity coating to withstand the corrosive environment of sub-stoichiometric combustion. The swirling air flow in annular space 336 continues toward the rear end 320 of combustion chamber 316 where it mixes with the secondary air flow supplied in annular space 336 by tangential nozzles 344 for above-stoichiometric combustion in combustion chamber 316. Preferably, the secondary air is supplied axially in the first axial portion 332 of the secondary air plenum chamber where a plurality of air vanes 352 are disposed. As shown in FIG. 17, a plurality of radially spaced angular slots 353 are defined by air vanes 352. The plurality of air vanes 352 and slots 353 provide a spinning flow to the secondary air, facilitate the entry of secondary air into tangential nozzles 344, and cool the inner metal surface of the second axial portion 334 of the secondary plenum chamber. If the secondary air is introduced tangentially into secondary plenum chamber 330, air vanes 352 are not necessary to achieve the desired swirling flow.

As can be seen in FIGS. 10 and 14, the third and fourth embodiments of the present invention preferably further include a substantially cylindrial exit throat 250 disposed at the rear end of their respective combustion chambers 216 and 316. Exit throat 250 is aligned substantially concentrically with the combustion chambers of the third and fourth embodiments for exhausting hot gases therefrom. Exit throat 250 has a diameter less than the diameter of the combustion chamber wall 222 and 322, respectively, of the third and fourth embodiments. It is also preferred that the combustion chambers of the third and fourth embodiments and exit throat 250 are dimensioned and configured to effect a cyclonic flow pattern in their respective combustion chambers having a Swirl number of at least 0.6 and a Reynolds number of at least 18,000. Exit throat 250 of the third and fourth embodiments is identical to exit throat 94 described earlier in connection with the second embodiment of the present invention. Gas swirler 62 described earlier in connection with the first embodiment of the invention may also be used in the third and fourth embodiments of the invention to enhance the swirling effect of the hot gases in combustion chambers 216 and 316.

The third and fourth embodiments of the invention also preferably include a substantially cylindrical cooling chamber 260 and 360, respectively, extending axially beyond the rear end of their respective combustion chambers 216 and 316. Cooling chambers 260 and 360 are also surrounded by the heat exchange means used in all four embodiments of the present invention.

The cooling effect of the heat exchange means of the present invention keeps the combustion temperature in the combustion chamber, i.e., the boiler furnace, lower than that in conventional cyclone combustion chambers. Preferably, the combustion temperature is less than about 2000° F. throughout its operation, including when the combustion apparatus is operated at maximum capacity. Because of this reduced temperature and the staged combustion present in all embodiments of the invention, $NO_x$ emissions can be reduced to an ultra-low level where $NO_x$ formation is lower than 25 PPM.

To further reduce the formation of $NO_x$, steam or water can be supplied in the sub-stoichiometric combustion stage of the present invention. It is expected that the combination of steam/water injection and cyclonic/swirling combustion will significantly reduce $NO_x$ formation below the level of 25 PPM.

In the first and second embodiments of the present invention, steam can be injected in the sub-stoichiometric combustion stage via either the fuel nozzles or the primary air nozzles. Alternatively, water can be injected axially into the combustion vessel of the first and second embodiments through openings (not shown). In the third and fourth embodiments, steam can again be injected in the sub-stoichiometric stage via the fuel nozzles or the primary air nozzles. It appears preferable in all embodiments that steam be injected through the fuel nozzles for a more significant reduction in $NO_x$ formation. When water is used as the cooling fluid for the heat exchange means of the present invention, steam exiting through port 60 (shown in FIG. 1) can be used as the source of the steam. A steam line can be provided between port 60 and either the fuel plenum chamber or the primary air plenum chamber of each embodiment.

Due to the cyclonic and swirling combustion, the excess air supplied to the combustion chamber in the secondary stream of air can be decreased to approximately 5% and can be kept constant over a high turndown ratio of 10:1. Control of the introduction of the primary and secondary streams of air is an important factor in all embodiments of the present invention. Control of the air streams may be accomplished in any conventional, well known manner. For instance, varying fan speeds and damper systems can be utilized for controlling the introduction of the primary and secondary air streams.

As noted earlier, an object of the present invention is to provide a combustion apparatus for minimizing the formation of $NO_x$ which can be retrofitted onto existing firetube boilers. Each of the four embodiments described herein can be retrofitted onto existing firetube boilers without cutting or welding either the Morison tube or the outer shell of the boiler. The means by which the four embodiments are connected to the firetube boiler is illustrated in the accompanying drawings.

It will be apparent to those skilled in the art that various modifications and variations can be made in the boiler combustion apparatus of the present invention. The invention in its broader aspects is, therefore, not limited to the specific details, representative apparatus, and illustrative examples shown and described above. Thus, it is intended that all matter contained in the foregoing description or shown in the accompanying drawings shall be interpreted as illustrative rather than limiting.

I claim:

1. A combustion apparatus for minimizing the formation of $NO_x$, the apparatus comprising:

an elongated combustion vessel having along its axial length a first and second combustion portion for sub-stoichiometric and above-stoichiometric combustion, respectively, the first and second portions being in communication and the combustion vessel including a substantially cylindrical wall;

means for supplying fuel into the first portion of said combustion vessel;

means for supplying a first stream of air into said first portion of said combustion vessel in an amount sufficient to form a fuel rich ratio for sub-stoichiometric combustion within the first portion of said combustion vessel;

means for tangentially supplying a second stream of air into the second portion of said combustion vessel to mix with the sub-stoichiometric combustion product gases and create a swirling air flow for above-stoichiometric combustion in said second combustion portion;

means for forming a cyclonic flow pattern of hot gases within at least one of said first and second combustion portions of said combustion vessel;

a cooling chamber extending rearwardly of the second portion of the combustion vessel for cooling the exhaust gases exiting from the second portion;

a gas swirler disposed between the second portion of the combustion vessel and the cooling chamber for promoting a swirling air flow thereby enhancing heat transfer; and heat exchange means surrounding at least the second portion of said combustion vessel for maintaining the temperature in the combustion vessel at less than about 2000° F. throughout its operation.

2. The apparatus as recited in claim 1, wherein the combustion vessel is dimensioned and configured to effect a cyclonic flow pattern having a Swirl number of at least 0.6 and a Reynolds number of at least 18,000 within one or both of said first and second combustion portions.

3. The apparatus as recited in claim 1 further comprising means for injecting steam into the first combustion portion to reduce the formation of $NO_x$.

4. A combustion apparatus for minimizing the formation of $NO_x$, the apparatus comprising:

a combustion vessel having first and second spaced opposite ends and a substantially cylindrical longitudinally extending wall;

an elongated orifice connected to said combustion vessel adjacent the second end thereof;

a combustion chamber having a front end, a rear end and a longitudinally extending wall, said elongated orifice connected to said combustion chamber adjacent said combustion chamber front end;

means for supplying fuel into the combustion vessel adjacent the first end thereof;

means for tangentially supplying a first stream of air into said combustion vessel and for forming a cyclonic flow pattern of hot gases for sub-stoichiometric combustion within said combustion vessel, the sub-stoichiometric combustion product gases formed by said sub-stoichiometric combustion flowing from said combustion vessel through said elongated orifice into said combustion chamber;

means for tangentially supplying a second stream of air into said orifice adjacent the front end of the combustion chamber and for forming a swirling air flow within said orifice and said combustion chamber for above-stoichiometric combustion therein;

a gas swirler disposed adjacent the rear end of the combustion chamber and a substantially cylindrical cooling chamber extending axially beyond the rear end of the combustion chamber and substantially longitudinally aligned with said chamber; and heat exchange means surrounding and extending substantially throughout the axial length of the combustion chamber for absorbing heat and cooling the combustion gases therein.

5. The apparatus as recited in claim 4, wherein the combustion chamber wall is substantially cylindrical for enhancing the swirling air flow within the combustion chamber.

6. The apparatus as recited in claim 1, wherein the combustion vessel is dimensioned and configured to effect a swirling flow pattern having a Swirl number of at least 0.6 and a Reynolds number of at least 18,000.

7. The apparatus as recited in claim 1, wherein the heat exchange means includes an outer shell surrounding the combustion chamber, a plurality of spaced gas tubes disposed between said outer shell and the combustion chamber wall for conducting hot gases from the combustion chamber, and a space within the shell exterior of the gas tubes and said combustion chamber wall for containing a cooling fluid.

8. The apparatus as recited in claim 7 wherein the cooling chamber is also surrounded by said outer shell, said plurality of spaced gas tubes and said cooling fluid.

9. The apparatus as recited in claim 1, wherein the combustion vessel wall is lined with refractory material.

10. The apparatus as recited in claim 9, wherein the elongated orifice includes an inner surface lined with refractory material.

11. The apparatus as recited in claim 1, wherein the combustion vessel wall includes an inner and an outer shell and wherein the means for supplying air into the combustion vessel includes a primary plenum chamber disposed between said inner and outer shells, said primary plenum chamber having an air inlet and a plurality of radially spaced primary air tangential nozzles communicating with the combustion vessel.

12. The apparatus as recited in claim 10, wherein the means for supplying fuel into the combustion vessel includes a fuel plenum chamber disposed between the inner and outer shells of the combustion vessel, the fuel plenum chamber having a fuel inlet and a plurality of radially spaced axial fuel nozzles communicating with the combustion vessel.

13. The apparatus as recited in claim 12, wherein the means for supplying air into the orifice includes a secondary plenum chamber fixed to and surrounding the orifice, the secondary plenum chamber including an air inlet and a plurality of radially spaced secondary tangential air nozzles communicating with the orifice.

14. The apparatus as recited in claim 1, wherein the heat exchange means is operative to maintain a temperature in the combustion chamber that is less than about 2000° F. throughout its operation.

15. The apparatus as recited in claim 1, further comprising means for injecting steam into the combustion vessel during sub-stoichiometric combustion for reducing the formation of $NO_x$.

16. A combustion apparatus for minimizing the formation of $NO_x$, the apparatus comprising:

a combustion vessel having first and second spaced opposite ends and a substantially cylindrical longitudinally extending wall;

a combustion chamber having a front end, a rear end and a substantially cylindrical longitudinally extending wall, said combustion vessel fixed to said combustion chamber with the second end of said combustion vessel inserted into the front end of the combustion chamber;

means for supplying fuel into the combustion vessel adjacent the first end thereof;

means for tangentially supplying a first stream of air into said combustion vessel and for forming a swirling air flow within said combustion vessel for sub-stoichiometric combustion therein;

a plurality of radially spaced tangential outlet nozzles disposed in the combustion vessel wall adjacent the second end thereof, said outlet nozzles being in communication with the combustion chamber for allowing the sub-stoichiometric combustion product gases generated within said combustion vessel to flow from said combustion vessel to the front end of said combustion chamber;

a substantially cylindrical exit throat at the rear of the combustion chamber and aligned substantially concentrica therewith for exhausting hot gases from the combustion chamber, the exit throat having a diameter less than the diameter of the combustion chamber wall;

means for tangentially supplying a second stream of air into said combustion chamber and for forming a cyclonic flow pattern of hot gases for above-stoichiometric combustion within said chamber; and heat exchange means surrounding and extending substantially throughout the axial length of the combustion chamber for absorbing heat and cooling the combustion gases therein.

17. The combustion apparatus as recited in claim 16, wherein the combustion chamber and exit throat are dimensioned and configured to effect a cyclonic flow pattern within said combustion chamber having a Swirl number of at least 0.6 and a Reynolds number of at least 18,000.

18. The apparatus as recited in claim 16, wherein the heat exchange means includes an outer shell surrounding the combustion chamber, a plurality of spaced gas tubes disposed between the shell and the combustion chamber wall, and a space within the shell exterior of the gas tubes and said combustion chamber wall for containing a cooling fluid.

19. The apparatus as recited in claim 16, wherein the combustion vessel is lined with refractory material.

20. The apparatus as recited in claim 16, wherein an annular space is formed between the combustion vessel disposed in the combustion chamber and the combustion chamber wall and the tangential outlet nozzles supply the sub-stoichiometric combustion product gases into said annular space.

21. The apparatus as recited in claim 20, wherein the combustion vessel wall includes an inner and outer shell and wherein the means for supplying air into the combustion chamber includes a secondary plenum chamber disposed between said inner and outer shell, the plenum chamber including a secondary tangential air inlet and a plurality of radially spaced secondary tangential air nozzles for supplying air tangentially into the annular space for mixing with the sub-stoichiometric combustion product gases.

22. The apparatus as recited in claim 21, wherein the means for supplying air into the combustion vessel includes a primary plenum chamber disposed between said inner and outer shell, said plenum chamber including a primary air inlet and a plurality of radially spaced primary tangential air nozzles for supplying air tangentially into the combustion vessel.

23. The apparatus as recited in claim 22 further comprising a cooling chamber positioned rearwardly of the exit throat for cooling the exhaust gases exiting through the exit throat.

24. The apparatus as recited in claim 21, wherein a plurality of air vanes are disposed in the annular space to promote the swirling air flow thereby enhancing heat transfer and cooling the combustion gases in the combustion chamber.

25. The apparatus as recited in claim 16, wherein the fuel supply means includes a fuel plenum chamber having a fuel inlet and a plurality of radially spaced fuel nozzles for axially injecting fuel into the combustion vessel.

26. The apparatus as recited in claim 16, wherein the heat exchange means is operative to maintain a temperature in the combustion chamber that is less than about 2000° F. throughout its operation.

27. The apparatus as recited in claim 16 further comprising means for injecting steam into the combustion vessel during sub-stoichiometric combustion for reducing the formation of $NO_x$.

28. A combustion apparatus for a boiler furnace to minimize $NO_x$ emissions, the apparatus comprising:

a combustion vessel having first and second spaced opposite ends and a substantially cylindrical longitudinally extending wall of substantially uniform inside diameter, said combustion vessel adapted to have at least said second end disposed in the boiler furnace;

means for supplying fuel into the combustion vessel adjacent the first end thereof;

means for tangentially supplying a first stream of air into the combustion vessel and for forming a swirling air flow within said combustion vessel for sub-stoichiometric combustion therein;

means for allowing the sub-stoichiometric combustion product gases generated in the combustion vessel to flow into the boiler furnace; and means for tangentially supplying a second stream of air into the boiler furnace and for forming a cyclonic flow pattern of hot gases for above-stoichiometric cyclonic combustion within the furnace.

29. A combustion apparatus for minimizing the formation of $NO_x$, the apparatus comprising:

a combustion chamber having a front end, a rear end and a substantially cylindrical longitudinally extending wall;

means for supplying fuel into the combustion chamber adjacent the front end thereof;

air supply means for tangentially supplying a first and second stream of air into the combustion chamber at spaced intervals along the axial length of said combustion chamber for sub-stoichiometric combustion and above-stoichiometric combustion, respectively, within said combustion chamber and for forming a swirling flow pattern of hot gases for combustion within said combustion chamber, the air supply means comprising an air plenum chamber disposed in the combustion chamber, said air plenum chamber having a diameter less than the diameter of said combustion chamber wall for forming an annular space therebetween, said air plenum chamber including an air inlet and a first and second group of radially spaced tangential nozzles disposed in spaced axial relationship to each other for supplying the first and second stream of air, respectively, in said annular space; and heat exchange means surrounding and extending substantially throughout the axial length of the combustion chamber for absorbing heat and cooling the combustion gases therein.

30. A combustion apparatus for a boiler furnace comprising:

means for supplying fuel into the boiler furnace; and air supply means for tangentially supplying a first and second stream of air into the boiler furnace at spaced intervals along the axial length of the furnace and for forming a cyclonic flow pattern of hot gases for combustion within the furnace, the first stream of air causing sub-stoichiometric combustion and the second stream of air causing above-stoichiometric combustion, the air supply means including an air plenum chamber adapted to be disposed in the boiler furnace, said air plenum chamber having a diameter less than the diameter of the boiler furnace for forming an annular space therebetween, said air plenum chamber including an air inlet and a first and second group of radially spaced tangential nozzles disposed in spaced axial relationship to each other for supplying the first and second stream of air, respectively, in said annular space.

31. The apparatus as recited in claim 30, wherein the fuel supply means includes a fuel plenum chamber, said fuel plenum chamber including a fuel inlet and a plurality of radially spaced axial fuel nozzles for supplying fuel into the annular space.

32. The apparatus as recited in claim 29, wherein the heat exchange means includes an outer shell surrounding the combustion chamber, a plurality of spaced gas tubes disposed between the outer shell and the combustion chamber wall for conducting hot gases formed in the combustion chamber, and a space within the shell exterior of the gas tubes and the combustion chamber wall for containing a cooling fluid.

33. The apparatus as recited in claim 29, wherein the fuel supply means includes a fuel plenum chamber surrounding the air plenum chamber, said fuel plenum chamber including a fuel inlet and a plurality of radially spaced axial fuel nozzles for supplying fuel into the annular space.

34. The apparatus as recited in claim 29, wherein the portion of the air plenum chamber disposed in the fire-tube is covered with refractory material.

35. The apparatus as recited in claim 29, wherein the heat exchange means is operative to maintain a temperature in the combustion chamber that is less than about 2000° F. throughout its operation.

36. The apparatus as recited in claim 29 further comprising a substantially cylindrical exit throat disposed at the rear end of the combustion chamber and aligned substantially concentrically therewith for exhausting hot gases from the combustion chamber, the exit throat having a diameter less than the diameter of the combustion chamber wall.

37. The apparatus as recited in claim 36, wherein the combustion chamber and the exit throat are dimensioned and configured to effect a cyclonic flow pattern in the combustion chamber having a Swirl number of at least 0.6 and a Reynolds number of at least 18,000.

38. The apparatus as recited in claim 29, further comprising a gas swirler disposed at the rear end of the combustion chamber for promoting a swirling air flow thereby increasing heat transfer to the wall of the combustion chamber.

39. The apparatus as recited in claim 36, further including a substantially cylindrical cooling chamber extending axially beyond the rear end of the combustion chamber and substantially longitudinally aligned with the combustion chamber, said cooling chamber also being surrounded by the outer shell, the plurality of spaced gas tubes and the cooling fluid.

40. The apparatus as recited in claim 29, wherein the fuel supply means includes means for injecting steam into the combustion chamber.

41. A combustion apparatus for minimizing the formation of $NO_x$, the apparatus comprising:

a combustion vessel having first and second spaced opposite ends and a substantially cylindrical longitudinally extending wall, said wall including an inner and outer shell;

an elongated orifice connected to said combustion vessel adjacent the second end thereof;

a combustion chamber having a front end, a rear end and a longitudinally extending wall, said elongated orifice connected to said combustion chamber adjacent said combustion chamber front end;

means for supplying fuel into the combustion vessel adjacent the first end thereof, said fuel supplying means including a fuel plenum chamber disposed between the inner and outer shells of the combustion vessel, the fuel plenum chamber having a fuel inlet and a plurality of radially spaced axial fuel nozzles communicating with the combustion vessel;

means for tangentially supplying a first stream of air into said combustion vessel and for forming a cyclonic flow pattern of hot gases for sub-stoichiometric combustion within said combustion vessel, the sub-stoichiometric combustion product gases formed by said sub-stoichiometric combustion flowing from said combustion vessel through said elongated orifice into said combustion chamber, the means for supplying the first stream of air into the combustion vessel including a primary plenum chamber disposed between the inner and outer shells of the combustion vessel, said primary plenum chamber having an air inlet and a plurality of radially spaced primary air tangential nozzles communicating with the combustion vessel;

means for tangentially supplying a second stream of air into said orifice adjacent the front end of the combustion chamber and for forming a swirling air flow within said orifice and said combustion chamber for above-stoichiometric combustion therein; and heat exchange means surrounding and extending substantially throughout the axial length of the combustion chamber for absorbing heat and cooling the combustion gases therein.

42. The apparatus as recited in claim 40, wherein the means for supplying air into the orifice includes a secondary plenum chamber fixed to and surrounding the orifice, the secondary plenum chamber including an air inlet and a plurality of radially spaced secondary tangential air nozzles communicating with the orifice.

43. A combustion apparatus for minimizing the formation of $NO_x$, the apparatus comprising:

a combustion chamber having a front end, a rear end and a substantially cylindrical longitudinally extending wall;

means for supplying fuel into the combustion chamber adjacent the front end thereof;

air supply means for tangentially supplying a first and second stream of air into the combustion chamber at spaced intervals along the axial length of said combustion chamber for sub-stoichiometric and above-stoichiometric combustion, respectively, within said combustion chamber and for forming a swirling flow pattern of hot gases for combustion within said combustion chamber, said air supply means comprising a primary air plenum chamber and a secondary air plenum chamber disposed coaxially in the combustion chamber, said secondary air plenum chamber including a first axial portion of a first predetermined diameter and a second axial portion of a second predetermined diameter greater than said first predetermined diameter, said primary air plenum chamber being axially coextensive with said first axial portion and having said second predetermined diameter, said second predetermined diameter being less that the diameter of said combustion chamber wall for forming an annular space therebetween, said primary air plenum chamber including an air inlet and a first group of radially spaced tangential nozzles for supply the first stream of air into the annular space and said secondary air plenum chamber including an air inlet and a second group of radially spaced tangential nozzles for supplying the second stream of air into the annular space; and heat exchange means surrounding and extending substantially throughout the axial length of the combustion chamber for absorbing heat and cooling the combustion gases therein.

44. A combustion apparatus for a boiler furnace comprising:

means for supplying fuel into the boiler furnace; and air supply means for tangentially supplying a first and second stream of air into the boiler furnace at spaced intervals along the axial length of the furnace and for forming a cyclonic flow pattern of hot gases for combustion within the furnace, the first stream of air causing sub-stoichiometric combustion and the second stream of air causing above-stoichiometric combustion, the air supply means comprising a primary air plenum chamber and a secondary air plenum chamber adapted to be disposed coaxially in the boiler furnace, said secondary air plenum chamber including a first axial portion of a first predetermined diameter and a second axial portion of a second predetermined diameter greater than said first predetermined diameter, said primary air plenum chamber being axially coextensive with said first axial portion and having said second predetermined diameter, said second predetermined diameter being less than the diameter of the furnace for forming a annular space therebetween, said primary air plenum chamber including an air inlet and a first group of radially spaced tangential nozzles for supplying the first stream of air and said secondary air plenum chamber including an air inlet and a second group of radially spaced tangential nozzles for supply the second stream of air.

45. The apparatus as recited in claim 43, wherein the fuel supply means includes a fuel plenum chamber surrounding and fixed to the primary air plenum chamber, said fuel plenum chamber including a fuel inlet and a plurality a radially spaced axial nozzles for supplying fuel into the annular space.

* * * * *

UNITED STATES PATENT AND TRADEMARK OFFICE

CERTIFICATE OF CORRECTION

PATENT NO. : 4,989,549

DATED : FEBRUARY 5, 1991

INVENTOR(S) : KORENBERG

It is certified that error appears in the above-identified patent and that said Letters Patent is hereby corrected as shown below:

Claim 6, col. 18, line 9, "claim 1" should be --claim 4--.

Claim 7, col. 18, line 13, "claim 1" should be --claim 4--.

Claim 9, col. 18, line 24, "claim 1" should be --claim 4--.

Claim 11, col. 18, line 29, "claim 1" should be --claim 4--.

Claim 16, col. 19, line 15, "rear" should be followed by --end--; and lines 16-17, "concentrica" should be --concentrically--.

UNITED STATES PATENT AND TRADEMARK OFFICE

CERTIFICATE OF CORRECTION

PATENT NO. : 4,989,549

DATED : February 5, 1991

INVENTOR(S) : Jacob Korenberg

It is certified that error appears in the above-identified patent and that said Letters Patent is hereby corrected as shown below:

Column 24, line 33, "a" should be --of--.

Signed and Sealed this

Fourth Day of August, 1992

*Attest:*

DOUGLAS B. COMER

*Attesting Officer*

*Acting Commissioner of Patents and Trademarks*